US008147210B2

(12) United States Patent
Gellner

(10) Patent No.: US 8,147,210 B2
(45) Date of Patent: Apr. 3, 2012

(54) ELECTRIC MOTOR IN AN OVERFLOW CAPTURE VESSEL IN A TANK

(75) Inventor: Thomas Gellner, Lohr (DE)

(73) Assignee: Robert Bosch GmbH, Stuttgart (DE)

( * ) Notice: Subject to any disclaimer, the term of this patent is extended or adjusted under 35 U.S.C. 154(b) by 517 days.

(21) Appl. No.: 12/392,759

(22) Filed: Feb. 25, 2009

(65) Prior Publication Data

US 2009/0246034 A1 Oct. 1, 2009

(30) Foreign Application Priority Data

Mar. 28, 2008 (DE) ..... 10 2008 016 023

(51) Int. Cl.
*F04B 49/04* (2006.01)

(52) U.S. Cl. ..... 417/40; 417/44.1

(58) Field of Classification Search ..... 417/40, 417/36, 366–370, 423.3, 423.8, 423.14, 440
See application file for complete search history.

(56) References Cited

U.S. PATENT DOCUMENTS

2007/0104589 A1* 5/2007 Marx ..... 417/87
* cited by examiner

*Primary Examiner* — Bumsuk Won
*Assistant Examiner* — Brenitra Lee
(74) *Attorney, Agent, or Firm* — Michael J. Striker

(57) ABSTRACT

A hydraulic assembly has a pressure medium container which at least partially encloses an electric motor, and a hydraulic pump which is driven by the electric motor using a simple, compact, and quiet design in a manner such that the electric motor is situated in the pressure medium container and is cooled by pressure medium without using the electric motor fan, in that the pressure medium container includes a partition which subdivides a pressure medium container interior at least partially into an intake region and a return region, and which maintains a certain level of pressure medium in the return region, and the electric motor is located in the return region of the pressure medium container.

7 Claims, 1 Drawing Sheet

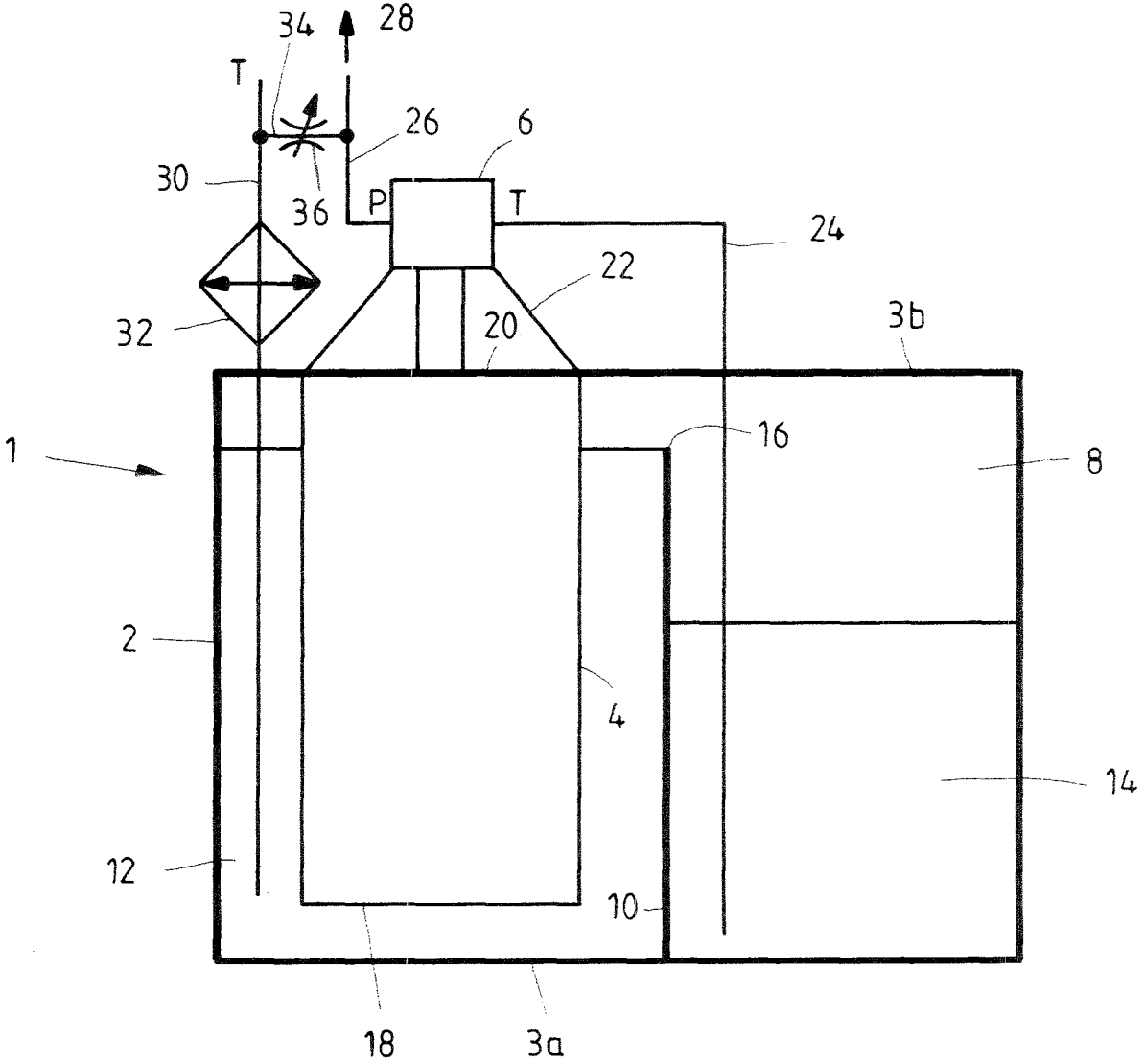
28
34
T
30
26
36
P
6
T
32
24
22
20
3b
8
16
1
4
2
14
10
12
3a
18

ELECTRIC MOTOR IN AN OVERFLOW CAPTURE VESSEL IN A TANK

CROSS-REFERENCE TO RELATED APPLICATION

The invention described and claimed hereinbelow is also described in German Patent Application DE 10 2008 016 023.7 filed on Mar. 26, 2008. This German Patent Application, whose subject matter is incorporated here by reference, provides the basis for a claim of priority of invention under 35 U.S.C. 119(a)-(d).

BACKGROUND OF THE INVENTION

The present invention relates to hydraulic assemblies, and, more particularly, to hydraulic assemblies for supplying a pressure medium, especially oil, to a consumer.

Hydraulic assemblies of this type are known, which include a hydraulic pump, an electric motor, and a pressure medium container which is used as a pressure medium reservoir and as storage space for the electric motor. Installation space and noise are advantageously reduced as a result. By operating the electric motor in the pressure medium, the heat budget is regulated in a simple manner and the noise situation is improved further. Oil-immersed motors are normally used, although they result in splash losses. By storing pressure medium, the pressure medium container compensates for an "oscillating volume" which is produced via different quantities of pressure medium being present in a hydraulic system, and which results in different levels of oil in the pressure medium container. As a result, sufficient cooling of the electric motor is not always ensured.

SUMMARY OF THE INVENTION

Accordingly, it is an object of the present invention to provide a hydraulic assembly of the above-described type, which ensures continual motor cooling using a very simple design.

In a hydraulic assembly according to the present invention, which includes a pressure medium container which encloses an electric motor in sections, and which includes a hydraulic pump which is driven by the electric motor, a partition is provided in the pressure medium container which subdivides a pressure medium container interior into an intake region and a return region, and which maintains a certain level of pressure medium in the return region in which the electric motor is situated. The partition ensures that a minimum quantity of continually-cooled pressure medium required to cool the electric motor is present in the return region, the electric motor being immersed in the pressure medium in a fluid-tight manner and without a fan device.

The pressure medium flows around the electric motor, thereby regulating the heat budget of the electric motor. The partition is simple to manufacture. By locating the electric motor in the container, the installation space is reduced, the noise situation is improved, and the electric motor is cooled simply and cost-effectively given that the fan unit is eliminated.

Further advantageous embodiments of a hydraulic valve according to the present invention are indicated in the dependent claims.

According to a particularly preferred embodiment of the present invention, the partition terminates with a partition upper edge at a certain distance from a container cover. As a result, it is attained in a cost-effective manner having a simple design that the pressure medium may flow from the return region to the intake region.

The electric motor, which is located in the return region, is fluid-tight in design, and is system or frequency regulated or controlled, is preferably immersed in the pressure medium in sections via a non-drive side which includes a fluid-tight end shield. Since the pressure medium does not flow through the space inside the motor, no splash losses occur.

When an electrical control extends through the electric motor and out of the pressure medium container, a terminal box may be eliminated, for example. A portion of the pump capacity of the hydraulic pump may be easily returned to the pressure medium container via a fixed or adjustable throttle. A permanent pressure medium circuit thereby results, which ensures that the hydraulic pump will be lubricated and cooled, and which minimizes the undesired pulsation of pressure.

The quantity of pressure medium returned via the return line preferably travels to the return region via a pressure medium cooler. This makes it possible to cool the electric motor, which is located in the return region. The cooled pressure medium flows around the electric motor and thereby regulates the heat budget of the electric motor, because it is possible for the heat produced during operation to be absorbed and carried away in an optimal manner by the pressure medium. The motor is more cost-effective as a result, since the fan unit is eliminated.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 of the drawings is a view schematically showing a hydraulic assembly in accordance with the present invention.

DESCRIPTION OF THE PREFERRED EMBODIMENTS

FIG. 1 shows a schematic design of a hydraulic assembly 1 according to the present invention. It includes a pressure medium container 2, an electric motor 4, and a hydraulic pump 6 having a constant or adjustable displacement. Electric motor 4 is located in pressure medium container 2, and hydraulic pump 6 is located outside of pressure medium container 2. Pressure medium container 2 includes a container base 3*a*, a container cover 3*b*, and a container interior 8. Interior 8 is provided with a partition 10 which subdivides interior 8 into a return region 12 and an intake region 14. Partition 10 has a free partition upper edge 16 which terminates a certain distance from container cover 3*b*. On the other edges, partition 10 is welded tight with the container outer walls. Above partition upper edge 16, return region 12 is connected to intake region 14.

Electric motor 4 is immersed in the pressure medium in sections in return region 12, and it includes a fluid-tight end shield on non-drive side 18 to prevent pressure medium from flowing into the interior of the motor. Drive side 20 of electric motor 4 is connected via a pump carrier 22 to hydraulic pump 6 which suctions pressure medium via a suction line 24 out of intake region 14 of pressure medium container 2, and conveys pressure medium via a pressure line 26 to a consumer 28 outside of the pressure medium container 2 as shown in the FIGURE, from which a return line 30 connected to the consumer 28 leads into pressure medium container 2 via a pressure medium cooler 32. Return line 30 terminates a short distance from pressure medium container base 3*a*. Between consumer 28 and hydraulic pump 6, a bypass line 34 extends from pressure line 26 via an adjustable throttle 36 to return line 30.

During operation, electric motor 4 drives hydraulic pump 6. Hydraulic pump 6 may pump a quantity of pressure medium that depends on the rotational speed of motor 4 to consumer 28. A partial quantity of the pressure medium which is pumped flows via bypass line 34 to pressure medium cooler 32 in accordance with the adjustable flow area of throttle 36 and the pump pressure and, having been cooled, empties into return region 12 of pressure medium container 2. The cooled pressure medium that returns continually from the throttle or the consumer to return region 12 results in a constant reduction in pressure medium temperature in return region 12. The minimum quantity of pressure medium to be contained in return region 12, which is determined by the level of the partition, is cooled to an extent which is sufficient to cool electric motor 4. The pressure medium may flow over partition upper edge 16 from return region 12 into intake region 14.

It will be understood that each of the elements described above, or two or more together, may also find a useful application in other types of constructions differing from the types described above.

While the invention has been illustrated and described as embodied in an electric motor in an overflow capture vessel in a tank, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

The invention claimed is:

1. A hydraulic assembly, comprising a pressure medium container for a pressure medium, said pressure medium container including a pressure medium container interior; an electric motor located in said pressure medium container interior; a hydraulic pump connectable to a consumer located outside of said pressure medium container and drivable by said electric motor in order to supply said pressure medium to said consumer, wherein said pressure medium container includes a partition which subdivides said pressure medium container interior into an intake region and a return region and has a return line connectable to said consumer, said return line being extendable from said consumer into said return region of said pressure medium container, so that quantity of said pressure medium is returnable from said consumer to the return region of the pressure medium container in order to maintain a certain level of said pressure medium in said return region, and wherein said electric motor is located in said return region of said pressure medium container so as to be coolable by the pressure medium during operation, and wherein a pressure medium cooler is provided in said return line.

2. A hydraulic assembly as defined in claim 1, wherein said pressure medium container includes a container base and a container cover, said partition terminating a certain distance away from said container cover via a partition upper edge which determines said certain level of said pressure medium present in said return region.

3. A hydraulic assembly as defined in claim 2, wherein said electric motor which is located in said return region includes a drive side which faces said container cover, and a non-drive side which faces said container base, is immersed in the pressure medium, and includes an end shield which is fluid-tight.

4. A hydraulic assembly as defined in claim 1, wherein said electric motor is an electric motor selected from the group consisting of a variable-speed motor and a mains-operated motor, and has an electrical connection extending from said return region of said pressure medium container to an outside.

5. A hydraulic assembly defined in claim 1, wherein said hydraulic pump has a portion of a pump capacity which is returnable to said pressure medium container via a throttle.

6. A hydraulic assembly as defined in claim 1, further comprising a pressure line connected to said hydraulic pump and connectable to said consumer whereby said pressure medium is conductible to said consumer, and wherein an adjustable throttle is connected between said pressure line and said return line so that a portion of said pressure medium is passable through said adjustable throttle into said return line and thereafter through said pressure medium cooler to said return region in order to help maintain said certain level of said pressure medium in the return region.

7. A hydraulic assembly comprising a pressure medium container for a pressure medium, said pressure medium container having an interior and a partition that subdivides said interior into an intake region and a return region;

an electric motor located in said return region of said interior;

a hydraulic pump connectable to a consumer located outside of said pressure medium container and drivable by said electric motor in order to conduct said pressure medium out of said pressure medium container to said consumer;

a return line connectable to said consumer and extendable from said return region to said consumer outside of said container and through which at least a portion of said pressure medium is returnable to the return region from said consumer in order to maintain a certain level of said pressure medium in the return region of said container; and a pressure medium cooling device provided in the return line so that said pressure medium is passable through said pressure medium cooling device and as a result is cooled sufficiently so that said electric motor located in said return region is cooled by said pressure medium in said return region.

* * * * *